US010418702B2

(12) United States Patent
Merrell

(10) Patent No.: US 10,418,702 B2
(45) Date of Patent: Sep. 17, 2019

(54) METHODS AND SYSTEMS FOR PERFORMING ANTENNA POINTING TO OVERCOME EFFECTS OF ATMOSPHERIC SCINTILLATION

(71) Applicant: VIASAT, INC., Carlsbad, CA (US)

(72) Inventor: Douglas J Merrell, Buford, GA (US)

(73) Assignee: Viasat, Inc., Carlsbad, CA (US)

( * ) Notice: Subject to any disclaimer, the term of this patent is extended or adjusted under 35 U.S.C. 154(b) by 326 days.

(21) Appl. No.: 15/261,425

(22) Filed: Sep. 9, 2016

(65) Prior Publication Data

US 2018/0076517 A1 Mar. 15, 2018

(51) Int. Cl.

| | |
|---|---|
| ***H01Q 3/00*** | (2006.01) |
| ***H01Q 3/08*** | (2006.01) |
| ***H01Q 21/00*** | (2006.01) |
| *H01Q 1/12* | (2006.01) |

(52) U.S. Cl.

CPC ..... *H01Q 3/08* (2013.01); *H01Q 21/00* (2013.01); *H01Q 1/1257* (2013.01); *H01Q 1/1264* (2013.01); *H01Q 3/00* (2013.01)

(58) Field of Classification Search

CPC ..... H01Q 3/08; H01Q 3/00; H01Q 1/1257; H01Q 1/1264; H01Q 21/00

USPC ..... 342/359, 368

See application file for complete search history.

(56) References Cited

U.S. PATENT DOCUMENTS 3,262,116 A * 7/1966 Arendt ..... B64G 1/1007 342/353
RE28,725 E * 2/1976 Hutchinson ..... B64G 1/1007 342/353
5,043,737 A * 8/1991 Dell-Imagine ..... G01S 3/42 342/352
5,274,382 A * 12/1993 Wills ..... H01Q 1/1257 342/359
5,463,401 A * 10/1995 Iwasaki ..... H01Q 1/1257 342/359
5,666,124 A 9/1997 Chethik et al.
6,075,482 A 6/2000 Fukushima
6,184,825 B1 * 2/2001 Wehner ..... H01Q 3/02 342/358

(Continued)

FOREIGN PATENT DOCUMENTS

| | | |
|---|---|---|
| JP | S 6244679 A | 2/1987 |
| JP | 2000-183627 A | 6/2000 |
| JP | 2002 094316 A | 3/2002 |

OTHER PUBLICATIONS

Advantech Wireless, "The INTRAC Algorithm" Whitepaper, www.advantechwireless.com, PN: WP-INTRAC 13224, An ISO 9001: 2008 Company, 4 pgs.

(Continued)

*Primary Examiner* — Chuong P Nguyen
(74) *Attorney, Agent, or Firm* — Holland & Hart LLP

(57) ABSTRACT

Systems and methods are described herein for performing mispointing correction operations that can provide very accurate pointing of an antenna towards a satellite. In particular, mispointing correction operations described herein can reduce or avoid pointing errors due to atmospheric scintillation effects. As a result, the mispointing correction operations described herein can improve resource efficiency of communication systems using such antennas and help ensure compliance with interference requirements of other satellites.

20 Claims, 8 Drawing Sheets

(56) References Cited

U.S. PATENT DOCUMENTS

| | | | | |
|---|---|---|---|---|
| 6,657,588 | B2 | 12/2003 | Strickland et al. | |
| 6,922,430 | B2 | 7/2005 | Biswas et al. | |
| 6,937,186 | B1 * | 8/2005 | Dybdal | G01S 3/22 342/147 |
| 7,446,721 | B2 | 11/2008 | Eom | |
| 7,800,537 | B2 * | 9/2010 | Dybdal | G01S 3/325 342/359 |
| RE42,472 | E | 6/2011 | Dybdal et al. | |
| 8,204,677 | B2 | 6/2012 | Rosenfeld et al. | |
| 8,284,112 | B2 * | 10/2012 | Otto | H01Q 3/08 343/757 |
| 9,123,988 | B2 * | 9/2015 | Irvine | H01Q 3/08 |
| 2006/0273965 | A1 * | 12/2006 | Gat | H01Q 1/3233 343/711 |
| 2012/0239333 | A1 | 9/2012 | Keene et al. | |
| 2018/0145744 | A1 * | 5/2018 | Petranovich | H04B 7/18519 |

OTHER PUBLICATIONS

Borgsmiller, "Effects of Atmospheric Scintillation in Ka-Band Satellite Communications", A Dissertation presented to the Faculty of the Division of Graduate Studies at Georgia Institute of Technology, Feb. 1998, 148 pgs.

Olivarez, "Mitigating the Effects of Ionospheric Scintillation on GPS Carrier Recovery", A Thesis Submitted to the Faculty of the Worcester Polytechnic Institute, May 2013, 121 pgs.

Otung, "Amplitude Scintillation of Ka-Band Satellite Signals", A Thesis Submitted to the University of Surrey, Aug. 1995, 331 pgs.

* cited by examiner

METHODS AND SYSTEMS FOR PERFORMING ANTENNA POINTING TO OVERCOME EFFECTS OF ATMOSPHERIC SCINTILLATION

BACKGROUND

The present disclosure relates generally to satellite communications, and more specifically to systems and methods for accurate antenna pointing in satellite communications.

An Earth-based antenna terminal for communication with a satellite typically has high antenna gain and a narrow main beam pointed at the satellite, because of the large distance to the satellite and to avoid interference with other satellites. Mobile antenna terminals include a positioner (or other pointing adjustment mechanism) to maintain pointing (or tracking) of the beam of the antenna at the satellite during movement.

Pointing error (or misalignment) between the boresight direction of maximum gain of the beam and the actual direction of the satellite can have a detrimental effect on the quality of the link between the antenna and the satellite. Small misalignment may be compensated for by reducing a modulation and coding rate of signals communicated between the antenna and the satellite. However, to maintain a given data rate (e.g., bits-per-second (bps)), this approach may increase system resource usage and thus result in inefficient use of the resources. Pointing error can also make it more challenging to ensure compliance with interference requirements with other satellites that are imposed by regulatory agencies (e.g., FCC, ITU, etc.) and/or a coordination agreement with operators of the other satellites.

The pointing error may increase with time due to various factors such as drift of a sensor (e.g., an inertial reference unit (IRU)) associated with mobile antenna terminal, structural deflections caused by movement and other disturbances, etc. In order to correct this pointing error, the mobile antenna terminal may occasionally perform a signal-based mispointing correction operation such as steptrack, conical scan and similar methods. The mispointing correction operation can include moving the beam of the antenna in an attempt to determine the direction at which a signal metric (e.g., signal strength) of a signal communicated with satellite is maximized.

SUMMARY

In one embodiment, a method is described for reducing atmospheric scintillation-induced error in antenna pointing. The method includes positioning a beam of an antenna to an initial angular position towards a target satellite and communicating a signal with the target satellite through the atmosphere. The method also includes performing a mispointing correction operation of the antenna. Performing the mispointing correction operation includes adjusting the beam of the antenna to a plurality of angular positions along a correction profile and measuring a signal metric of the communicated signal at the plurality of angular positions. The plurality of angular positions include a first angular position and a second angular position that are on opposing sides of the initial angular position. A time difference between each measurement of the signal metric at the first angular position of the correction profile and at least one measurement of the signal metric at the second angular position of the correction profile is less than or equal to $1/f_0$, where $f_0$ is a Fresnel frequency of an atmospheric scintillation spectrum of the communicated signal due to the atmosphere. Performing the mispointing correction operation also includes estimating an actual angular position of the target satellite based on the measured signal metric of the communication signal at the plurality of angular positions. Performing the mispointing correction operation also includes positioning the beam of the antenna relative to the initial angular position based on the estimated angular position of the target satellite.

In another embodiment, an antenna system is described for reducing atmospheric scintillation error in antenna pointing. The antenna system includes an antenna having a beam for communicating a signal with a target satellite through the atmosphere. The antenna system further includes a pointing adjustment mechanism coupled to the antenna and responsive to a control signal to adjust an angular position of the beam of the antenna. The antenna system further includes an antenna control unit to provide the control signal to the pointing adjustment mechanism to perform a mispointing correction operation of the antenna. The mispointing correction operation includes adjusting the beam of the antenna to a plurality of angular positions along a correction profile and obtaining a signal metric of the communicated signal measured at the plurality of angular positions. The plurality of angular positions include a first angular position and a second angular position that are on opposing sides of an initial angular position towards the target satellite. A time difference between each measurement of the signal metric at the first angular position of the correction profile and at least one measurement of the signal metric at the second angular position of the correction profile is less than or equal to $1/f_0$, where $f_0$ is a Fresnel frequency of an atmospheric scintillation spectrum of the communicated signal due to the atmosphere. The mispointing correction operation further includes estimating an actual angular position of the target satellite based on the measured signal metric of the communication signal at the plurality of angular positions. The mispointing correction operation further includes positioning the beam of the antenna relative to the initial angular position based on the estimated angular position of the target satellite.

Other aspects and advantages of the present disclosure can be seen on review of the drawings, the detailed description, and the claims which follow.

DETAILED DESCRIPTION

Systems and methods are described herein for performing mispointing correction operations that can provide very accurate pointing of an antenna towards a satellite (e.g., a geostationary satellite). In particular, mispointing correction operations described herein can reduce or avoid pointing errors due to atmospheric scintillation effects that can cause pointing errors in conventional mispointing correction operations. As a result, the mispointing correction operations described herein can improve resource efficiency of communication systems using such antennas. For example, achieving accurate pointing (i.e., less residual pointing error) may reduce the necessary system resources for maintaining a given data rate by increasing the allowable coding rate (e.g., decreasing data redundancy), which may increase overall system performance. In addition, by avoiding or reducing pointing errors due to atmospheric scintillation effects, the mispointing correction operations described herein can reduce the overall pointing error of the antenna and help ensure compliance with interference requirements of other satellites.

Figure 1:
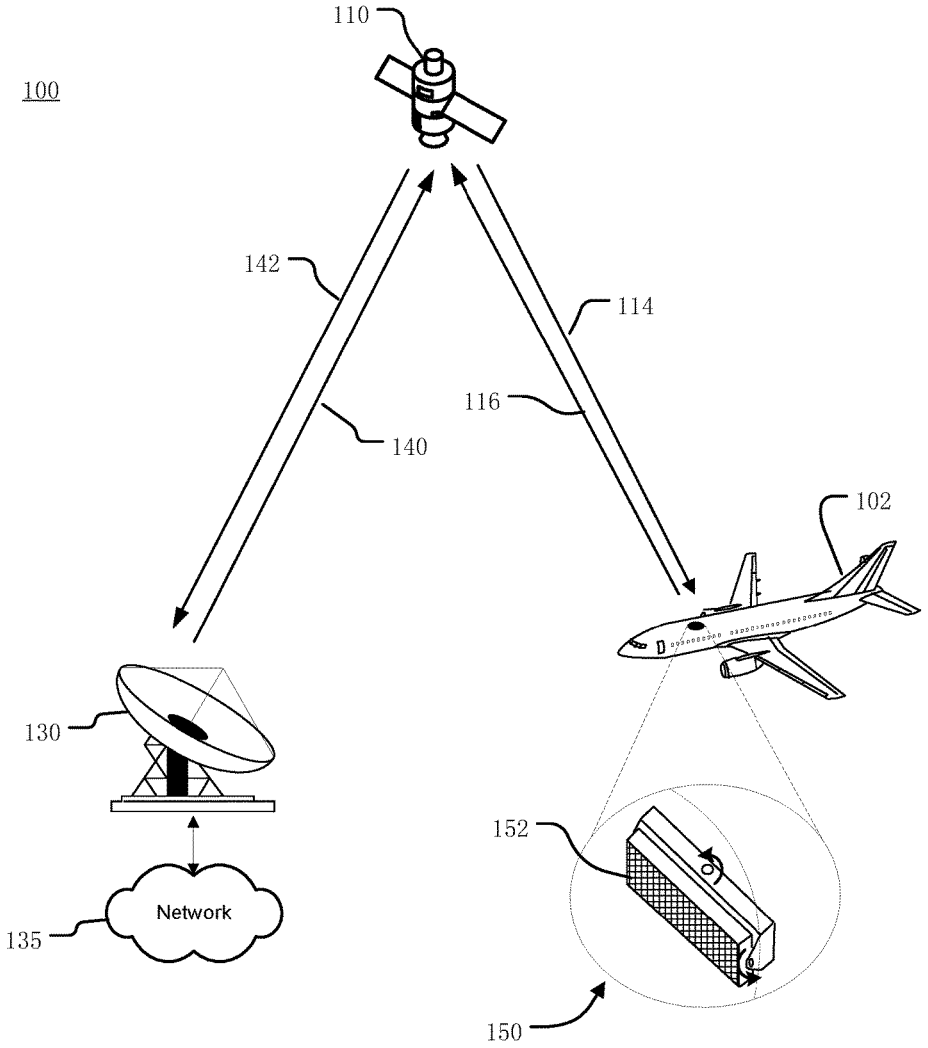
FIG. 1 illustrates an example satellite communications system in which an antenna system as described herein can be used to provide very accurate pointing towards a satellite.

FIG. 1 illustrates an example satellite communications system 100 in which an antenna system 150 as described herein can be used to provide very accurate pointing towards satellite 110 (referred to hereinafter as "target satellite 110"). Many other configurations are possible having more or fewer components than the satellite communications system 100 of FIG. 1.

In the illustrated embodiment, the antenna system 150 is mounted on aircraft 102, which in this example is an airplane. More generally, the antenna system 150 can be mounted on various types of mobile vehicles such as aircraft (e.g., airplanes, helicopters, drones, blimps, balloons, etc.), trains, automobiles (e.g., cars, trucks, busses, etc.), watercraft (e.g., private boats, commercial shipping vessels, cruise ships, etc.) and others, or can be mounted to a stationary object (e.g., a building) or otherwise placed in a fixed location such as gateway system.

As described in more detail below, the antenna system 150 includes an antenna 152 producing a beam that facilitates communication between the aircraft 102 and the target satellite 110. In the illustrated embodiment, the antenna 152 is an array of waveguide antenna elements arranged in a rectangular panel. Each of the one or more antenna elements can include a waveguide-type feed structure including a horn antenna. Alternatively, the antenna 152 may be a different type of antenna, such as a reflector antenna, a phased array, a slot array, etc.

The antenna system 150 also includes a pointing adjustment mechanism such as a mechanical positioner (not shown) responsive to a control signal from an antenna control unit (not shown) to provide very accurate pointing of the beam of the antenna 152 at the target satellite 110 using the techniques described herein. In some embodiments described herein the antenna system 150 is used for bidirectional (two-way) communication with the target satellite 110. In other embodiments, the antenna system 150 may be used for unidirectional communication with the target satellite 110, such as a receive-only implementation (e.g., receiving satellite broadcast television). Although only one antenna system 150 is illustrated in FIG. 1 to avoid over complication of the drawing, the satellite communications system 100 may include many antenna systems 150.

As used herein, a beam of an antenna that is pointed at a satellite has sufficient antenna gain in the direction of the satellite to permit communication of one or more signals. The communication can be bidirectional (i.e., the antenna transmits a signal to the satellite and also receives a signal from the satellite) or unidirectional (i.e., the antenna either transmits a signal to the satellite or receives a signal from the satellite, but not both). The direction of the satellite may be the boresight direction of maximum gain of the beam. Alternatively, the gain of the beam in the direction of the satellite may be less than the maximum gain of the beam. This may for example be due to pointing accuracy limitations of the antenna. The difference between the boresight direction of the beam and the direction of the satellite is referred to herein as the pointing error.

In the illustrated embodiment, the target satellite 110 provides bidirectional communication between the aircraft 102 and a gateway terminal 130. The gateway terminal 130 is sometimes referred to as a hub or ground station. The gateway terminal 130 includes an antenna to transmit a forward uplink signal 140 to the target satellite 110 and receive a return downlink signal 142 from the target satellite 110. The gateway terminal 130 can also schedule traffic to the antenna system 150. Alternatively, the scheduling can be performed in other parts of the satellite communications system 100 (e.g., a core node, or other components, not shown). Signals 140, 142 communicated between the gateway terminal 130 and the target satellite 110 can use the same, overlapping, or different frequencies as signals 114, 116 communicated between the target satellite 110 and the antenna system 150.

Network 135 is interfaced with the gateway terminal 130. The network 135 can be any type of network and can include for example, the Internet, an IP network, an intranet, a wide area network (WAN), a virtual LAN (VLAN), a fiber optic network, a cable network, a public switched telephone network (PSTN), a public switched data network (PSDN), a public land mobile network, and/or any other type of network supporting communication between devices as described herein. The network 135 can include both wired and wireless connections as well as optical links. The network 135 can connect multiple gateway terminals 130 that can be in communication with target satellite 110 and/or with other satellites.

The gateway terminal 130 can be provided as an interface between the network 135 and the target satellite 110. The gateway terminal 130 can be configured to receive data and information directed to the antenna system 150 from a source accessible via the network 135. The gateway terminal 130 can format the data and information and transmit forward uplink signal 140 to the target satellite 110 for delivery to the antenna system 150. Similarly, the gateway terminal 130 can be configured to receive return downlink signal 142 from the target satellite 110 (e.g., containing data and information originating from the antenna system 150) that is directed to a destination accessible via the network 135. The gateway terminal 130 can also format the received return downlink signal 142 for transmission on the network 135.

The target satellite 110 can receive the forward uplink signal 140 from the gateway terminal 130 and transmit corresponding forward downlink signal 114 to the antenna system 150. Similarly, the target satellite 110 can receive return uplink signal 116 from the antenna system 150 and transmit corresponding return downlink signal 142 to the gateway terminal 130. The target satellite 110 can operate in a multiple spot beam mode, transmitting and receiving a number of narrow beams directed to different regions on Earth. Alternatively, the target satellite 110 can operate in wide area coverage beam mode, transmitting one or more wide area coverage beams. In some embodiments, the target satellite 110 is a geostationary satellite. In other embodiments, the target satellite 110 is a non-geostationary satellite, such as a LEO or MEO satellite.

The target satellite 110 can be configured as a "bent pipe" satellite that performs frequency and polarization conversion of the received signals before retransmission of the signals to their destination. As another example, the target satellite 110 can be configured as a regenerative satellite that demodulates and remodulates the received signals before retransmission.

As mentioned above, the antenna system 150 includes antenna 152 that produces a beam pointed at the target satellite 110 via the pointing adjustment mechanism to provide for transmission of the return uplink signal 116 and reception of the forward downlink signal 114. Based on the location of the target satellite 110 and the location and attitude (yaw, roll and pitch) of the aircraft 102, the antenna control unit of the antenna system 150 provides a control signal to the pointing adjustment mechanism to change the angular position of the beam to maintain pointing of the beam of the antenna 152 at the target satellite 110 as the aircraft 102 moves. However, various factors such as drift of a navigation sensor (e.g., an inertial reference unit (IRU)) on the aircraft 102, structural deflections of the aircraft 102 caused by movement and other disturbances, etc., can cause the pointing error to increase with time.

Thus, from time-to-time, the antenna control unit also provides appropriate values of the control signal to the pointing adjustment mechanism to perform the mispointing correction operation as described herein. At the beginning of the mispointing correction operation, the initial angular position is the direction the positioner is pointing the beam of the antenna in the direction of the target satellite. The mispointing correction operation described herein can reduce or avoid atmospheric scintillation-induced pointing errors. In doing so, the mispointing correction operations described herein can provide more accurate pointing than conventional mispointing correction operations.

Atmospheric scintillation is the result of variations in temperature, barometric pressure, and water vapor content that cause turbulence between the stratified layers of the atmosphere. This results in changes in the attenuation of signals propagating through the atmosphere, including the forward downlink signal 114 and the return uplink signal 116 communicated between target satellite 110 and the antenna system 150.

In conventional mispointing correction operations, the direction of the beam may be moved around in attempt to determine the direction at which a signal metric (e.g., signal strength) of a signal (e.g., the forward downlink signal 114) is maximized. However, in these conventional operations, it has been found that the scintillation-induced signal variations can affect the measured signal metric differently at the various positions, which can cause errors in determining the actual direction of the target satellite 110. As a result, these conventional mispointing correction operations cannot distinguish signal variations from pointing alignment or atmospheric scintillation effects. Thus, the scintillation-induced signal variations can result in pointing error of the antenna 152.

As described in more detail below, the mispointing correction operation described herein is based on the recognition and appreciation that scintillation-induced signal variations are correlated in time and are a relatively low frequency phenomena. In other words, the correlation of scintillation-induced signal variations a measured signal metric at different angular positions depends on the time difference between the measurements. Thus, for measurements at different angular positions that are sufficiently close together in time, the scintillation-induced signal variations can be similar, such that the difference between the measurements can be largely independent of the scintillation. Accordingly, by moving rapidly between different angular positions (for example, opposing sides of the beam), and estimating the actual direction of the target satellite based on a relative comparison of the measurements, the scintillation-induced variations are largely irrelevant to the estimate, thereby providing a more accurate indication of the actual direction of the target satellite.

Figure 2:
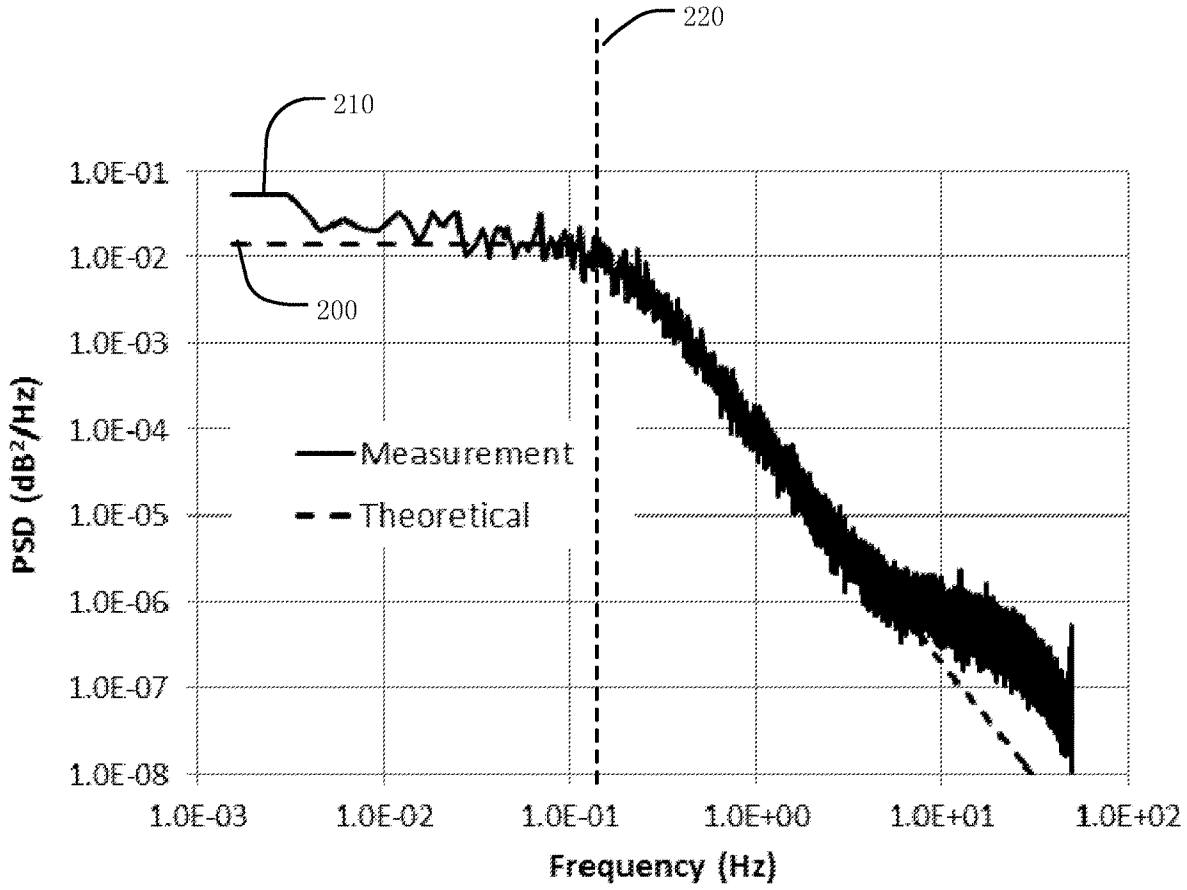
FIG. 2 is an example graph of power spectral density (PSD) of the atmospheric scintillation spectrum of a signal communicated between the antenna system and the satellite due to the atmosphere.

FIG. 2 is an example graph of power spectral density (PSD) of the atmospheric scintillation spectrum of a signal communicated between the antenna system 150 and the target satellite 110 due to the atmosphere. The graph includes an example curve 200 showing the theoretical PSD of the atmospheric scintillation spectrum of the signal, as well as an example curve 210 showing the measured PSD of the atmospheric scintillation spectrum of the signal. The graph shows that the theoretical PSD closely matches the measured PSD. The PSD values and the Fresnel frequency ($f_0$) of the atmospheric scintillation spectrum can vary from embodiment to embodiment, and can depend on the size of the aperture of the antenna 152 and the frequency of the signal being communicated between the antenna system 150 and the target satellite 110. In other embodiments, rather than calculating the PSD, the PSD values and the Fresnel frequency ($f_0$) of the atmospheric scintillation spectrum may for example be determined empirically.

As can be seen in the graph, the PSD of the atmospheric scintillation spectrum is essentially flat up to a roll-off frequency ($f_0$) 220, after which it rolls off with $f^{-8/3}$ dependence. The roll-off frequency ($f_0$) 220 is referred to herein as the Fresnel frequency. Due to the shape of the atmospheric scintillation spectrum, scintillation-induced signal variations generally have a period of a few seconds or greater. In other words, the correlation of the scintillation-induced signal variations depends on the time difference between the measurements. This is a contrast to a white noise source that has a constant PSD and results in no time-dependent correlation.

As a result, during a mispointing correction operation using the signal, the scintillation-induced signal variations between two different angular positions is dependent on the time difference between the measurements at those two angular positions. Specifically, if the time difference between signal metric measurements at two positions is less than or equal to $1/f_0$, the scintillation-induced signal variations are referred to herein as highly correlated. In contrast, if the time difference between the measurements at the two positions is greater than $1/f_0$, the scintillation-induced signal variations are referred to herein as poorly correlated.

In embodiments described herein, the mispointing correction process is performed using the antenna 152 of antenna system 150 such that the time difference between signal metric measurements at two angular positions on opposing sides of the initial angular position of the beam is less than or equal to $1/f_0$. By making these rapid measurements on the opposing sides, the scintillation-induced signal variations affect the measurements on both sides in a similar way, such the subsequent estimate of the actual direction of the target satellite based on a relative comparison of the measurements (e.g., a least-squares regression) tends to reduce or cancel out the scintillation effects. In doing so, the scintillation-induced variations are largely irrelevant to the estimate, thereby providing a more accurate indication of the actual direction of the target satellite.

In some embodiments, the two angular positions that are on opposing sides of the initial angular position are, when projected onto a plane perpendicular to the initial angular position, directly opposite (i.e., rotated 180 degrees) from each other relative to the initial angular position. In other words, a line within the plane and extending between the two angular positions, intersects the initial angular position. In other embodiments, the two angular positions are not directly opposite from each other relative to the initial angular position. More generally, the two angular positions that are on opposing sides of the initial angular position may be any angular separation that permits the techniques described herein to reduce or avoid atmospheric scintillation induced pointing errors.

Figure 3:
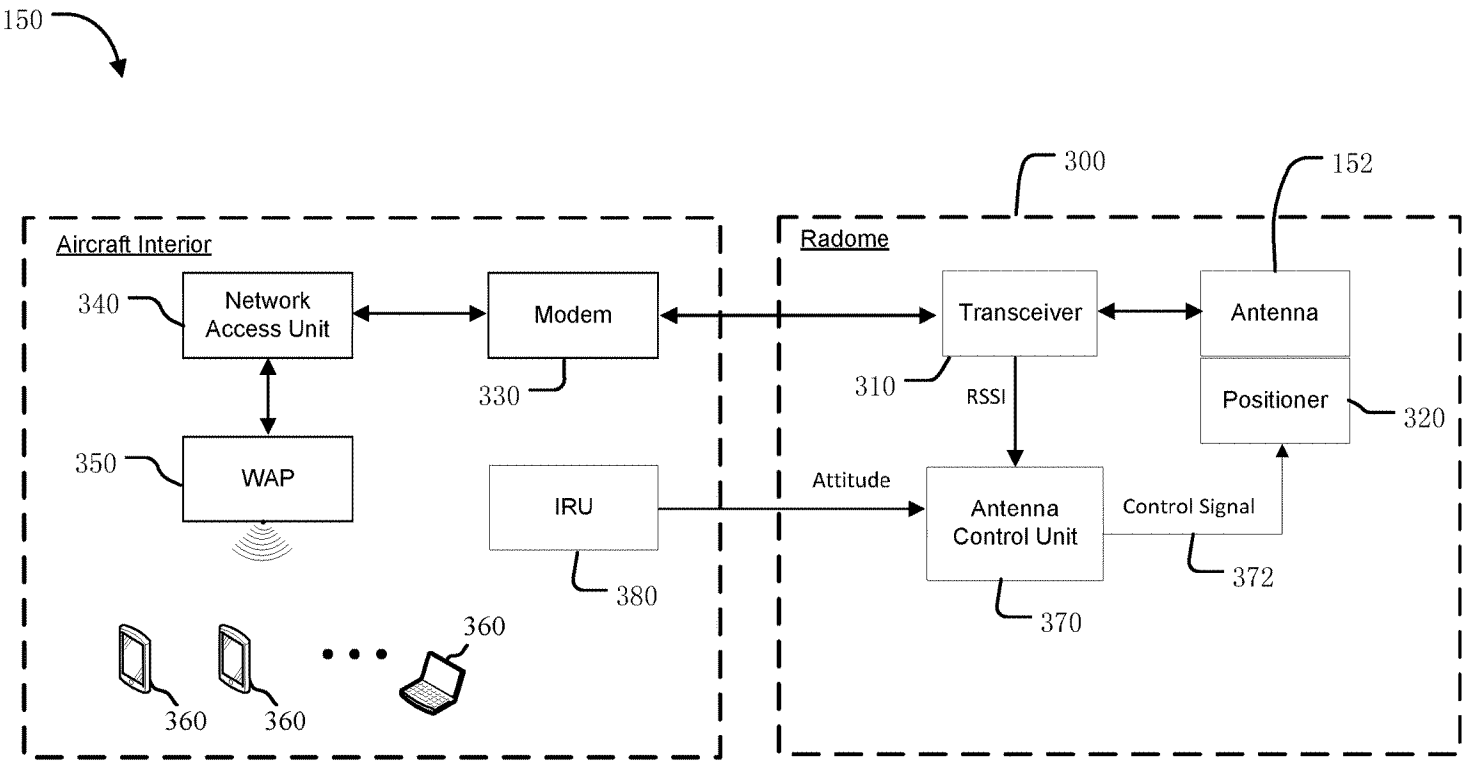
FIG. 3 is a block diagram illustrating an example antenna system on the aircraft of FIG. 1.

FIG. 3 is a block diagram illustrating an example antenna system 150 on the aircraft 102 of FIG. 1. Many other configurations are possible having more or fewer components than the antenna system 150 shown in FIG. 3. Moreover, the functionalities described herein can be distributed among the components in a different manner than described herein.

The antenna system 150 includes antenna 152 that is housed under radome 300 disposed on the top of the fuselage or other location (e.g., on the tail, etc.) of the aircraft 102. The antenna 152 produces a beam that can provide for transmission of the return uplink signal 116 and reception of the forward downlink signal 114 to support two-way data communication between data devices 360 within the aircraft 102 and the network 135 via target satellite 110 and gateway terminal 130. The data devices 360 can include mobile devices (e.g., smartphones, laptops, tablets, netbooks, and the like) such as personal electronic devices (PEDs) brought onto the aircraft 102 by passengers. As further examples, the data devices 360 can include passenger seat back systems or other devices on the aircraft 102. The data devices 360 can communicate with network access unit 340 via a communication link that can be wired or wireless. The communication link can be, for example, part of a local area network such as a wireless local area network (WLAN) supported by wireless access point (WAP) 350. One or more WAPs can be distributed about the aircraft 102, and can, in conjunction with network access unit 340, provide traffic switching or routing functionality. The network access unit 340 can also allow passengers to access one or more servers (not shown) local to the aircraft 102, such as a server that provides in-flight entertainment.

In operation, the network access unit 340 can provide uplink data received from the data devices 360 to modem 330 to generate modulated uplink data (e.g., a transmit IF signal) for delivery to transceiver 310. The transceiver 310 can then upconvert and then amplify the modulated uplink data to generate the return uplink signal 116 for transmission to the target satellite 110 via the antenna 152. Similarly, the transceiver 310 can receive the forward downlink signal 114 from the target satellite 110 via the antenna 152. The transceiver 310 can amplify and then downconvert the forward downlink signal 114 to generate modulated downlink data (e.g., a receive IF signal) for demodulation by the modem 330. The demodulated downlink data from the modem 330 can then be provided to the network access unit 340 for routing to the data devices 360. The modem 330 can be integrated with the network access unit 340, or can be a separate component, in some examples.

In the illustrated embodiment, the transceiver 310 is located outside the fuselage of the aircraft 102 and under the radome 300. Alternatively, the transceiver 310 can be located in a different location, such as within the aircraft interior.

In the illustrated embodiment and subsequent examples, the antenna system 150 includes positioner 320 coupled to the antenna 152. Alternatively, the antenna system 150 may include a different pointing adjustment mechanism that may vary from embodiment to embodiment, and may depend on the antenna type of the antenna 152.

The positioner 320 is responsive to a control signal on line 372 from antenna control unit 370 to point the beam of the antenna 152 in the direction of the target satellite 110 as the aircraft 102 moves. The mechanism of the positioner 320 used to point the beam of the antenna 152 may vary from embodiment to embodiment, and may depend on the antenna type of the antenna 152. Accordingly, the values of the control signal on line 372 to adjust the angular position of the beam depend on the manner in which the mechanism of the positioner 320 (or other pointing adjustment mechanism) is controlled, and can vary from embodiment to embodiment. Although only a single line 372 and a single control signal are shown in FIG. 3, as used herein "control signal" can include one or more separate control signals provided by the antenna control unit 370 to the positioner 320 (or other pointing adjustment mechanism), which in turn may be provided on one or more lines. For example, in some embodiments in which the pointing adjustment mechanism adjusts the angular position of the beam in multiple axes (e.g., azimuth and elevation), the control signal includes a control signal indicating the angular value of each axis.

In some embodiments, the boresight direction of the antenna 152 is fixed relative to the aperture of the antenna 152. For example, the antenna 152 may be a direct radiating two-dimensional array which results in boresight being normal to a plane containing the antenna elements of the array. As another example, the antenna 152 may be a reflector antenna. In such a case, the antenna 152 can be fully mechanically steered by the positioner 320 to point the beam at the target satellite 110. For example, the positioner 320 may be an elevation-over-azimuth (EL/AZ), two-axis positioner that provides adjustment in azimuth and elevation. As another example, the positioner 320 may be a three-axis positioner to provide adjustment in azimuth, elevation and skew.

In some embodiments, the antenna 152 is an electromechanically steered array that includes one mechanical scan axis and one electrical scan axis, such as a variably inclined continuous transverse stub (VICTS) antenna. In such a case, the pointing adjustment mechanism can include a combination of mechanical and electrical scanning mechanisms.

In some embodiments, the antenna 152 is a non-movable, fully electronic scanned phased array antenna. In such a case, the pointing adjustment mechanism can include feed networks and phase controlling devices to properly phase signals communicated with some or all of the antenna elements 152 to scan the beam in azimuth and elevation.

As mentioned above, the antenna control unit 370 provides a control signal on line 372 to positioner 320 to point the beam of the antenna 152. The functions of the antenna control unit 370 can be implemented in hardware, instructions embodied in memory and formatted to be executed by one or more general or application specific processors, firmware, or any combination thereof.

During normal operation, as the aircraft 102 moves relative to the target satellite 110, the antenna control unit 370 provides the control signal on line 372 to positioner 320 to point the beam of the antenna 152 in the appropriate angular position in the direction of the target satellite 110. The antenna control unit 370 may determine the appropriate angular position based on the location of the target satellite 110, the location of the aircraft 102, and the attitude (including yaw, roll, and pitch) of the aircraft 102. The antenna control unit 370 may for example store (or otherwise obtain) data indicating the location of the target satellite 110. The location of the aircraft 102 may for example be obtained via a global positioning system (GPS) (not shown) or other equipment on the aircraft 102. The attitude of the aircraft 102 may for example be provided via an inertial reference unit (IRU) 380 on the aircraft 102.

From time to time, the antenna control unit 370 also provides the control signal on line 372 to perform a mispointing correction operation as described herein. The manner in which the antenna control unit 370 initiates the mispointing correction operation can vary from embodiment to embodiment.

In some embodiments, the antenna control unit 370 receives a command to begin the mispointing correction operation. The command may for example be received, periodically, such as every 15 minutes. The command may also or alternatively be received upon detection of possible performance degradation that could be caused by mispointing of the beam of the antenna. The command may for example be transmitted to the antenna control unit 370 by the gateway terminal 130 (or other elements of the satellite communications system 100 such as a core node, NOC, etc.) via the forward downlink signal 114. As another example, the command may be received by other equipment (e.g., modem 330, transceiver 310, etc.) of the antenna system 150 or other equipment on the aircraft 102.

In some embodiments, the antenna control unit 370 automatically performs the mispointing correction operation, without receiving a command. For example, the antenna control unit 370 may perform the mispointing correction operation periodically, such as every 15 minutes.

During the mispointing correction operation, the antenna control unit 370 can provide control signal on line 372 to positioner 320 to adjust the beam of the antenna 152 to various angular positions of a correction profile. At the same time, the antenna control unit 370 obtains an indication of signal strength (or other signal metric such as signal-to-noise ratio, bit-error rate, etc.) of a signal communicated with the target satellite 110 while at the various angular positions. The manner in which the beam of the antenna 152 is adjusted to the various angular positions is discussed in more detail below.

In the illustrated embodiment, the antenna control unit 370 obtains a received signal strength indicator (RSSI) from the transceiver 310 (or other component such as modem 330) indicating the signal strength of the forward downlink signal 114 at the various angular positions. Alternatively, other techniques may be used. For example, in some embodiments, the mispointing correction operation may also or alternatively use the signal strength (or other signal metric) of a signal transmitted by the antenna 152 to the target satellite 110, such as the return uplink signal 116. In such a case, the antenna control unit 370 may receive the signal strength (or other signal metric) of the return uplink signal 116 that was received by the target satellite 110 from the gateway terminal 130 (or other elements of the satellite communications system 100 such as a core node, NOC, etc.) via the forward downlink signal 114.

The antenna control unit 370 can then select the final angular position to point the beam of the antenna 152 based on the measured signal metric at the various angular positions. The antenna control unit 370 may use a variety of techniques to select the final angular position. For example, the antenna control unit 370 may fit the measurements to a 2-D or 3-D curve depending upon the correction profile of the mispointing correction operation, and then select the angular position corresponding to the maximum signal metric (e.g., maximum signal strength). Alternatively, other techniques may be used. The antenna control unit 370 can then provide the control signal to the positioner 320 to adjust the beam of the antenna 152 to point in the selected angular position. The antenna control unit 370 can then return to normal operations, and provide further adjustments to the angular position of the beam as the aircraft 102 moves relative to the target satellite 110.

Figure 4:
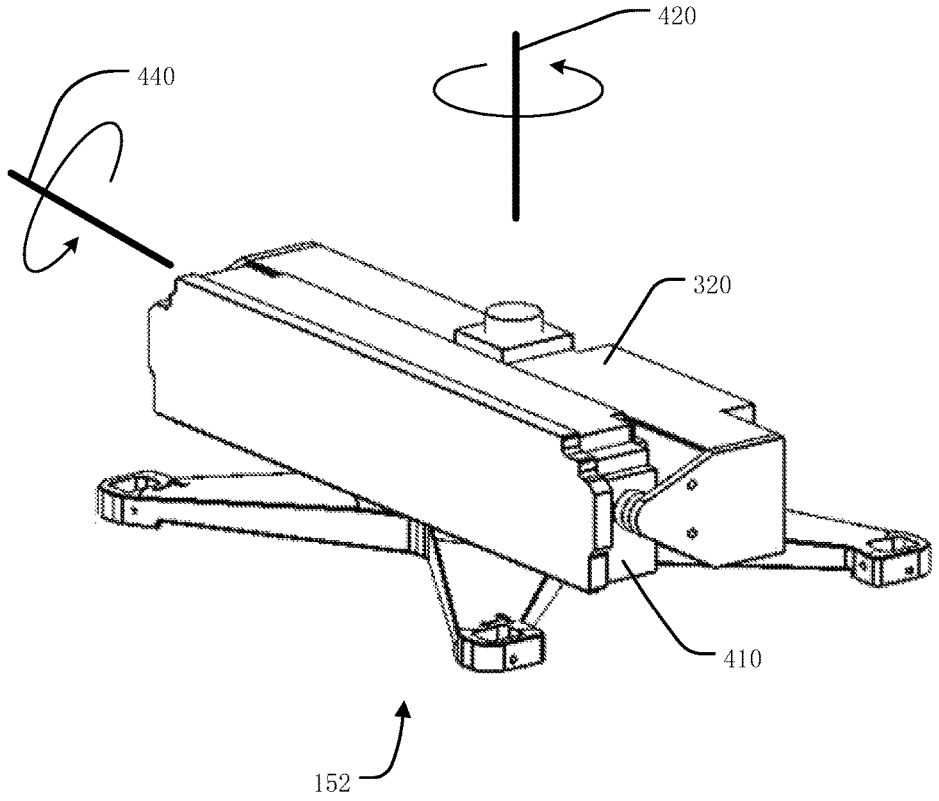
FIG. 4 illustrates a perspective view of an example of antenna and positioner of an example antenna system.

FIG. 4 illustrates a perspective view of an example of antenna 152 and positioner 320 of antenna system 150. In the illustrated embodiment, the antenna 152 includes an array 410 of antenna elements that is a direct radiating two-dimensional array which results in boresight being normal to a plane containing the antenna elements of the array 410. Alternatively, the array 410 of antenna elements can be arranged or fed in a different manner such that boresight is not normal to the plane containing the antenna elements of the array 410. As mentioned above, in other embodiments the antenna type of the antenna 152 may be different.

The positioner 320 is responsive to control signal provided by the antenna control unit 370 (see FIG. 3) to point the beam of the antenna 152 at the target satellite 110. In the illustrated embodiment, the positioner 320 is an elevation-over-azimuth (EL/AZ) two-axis positioner that provides full two-axis mechanical steering. The positioner 320 includes a mechanical azimuth adjustment mechanism to move the beam of the antenna 152 is azimuth 420, and a mechanical elevation adjustment mechanism to move the beam of the antenna 152 is elevation 440. Each of the mechanical adjustment mechanisms can for example include a motor with gears and other elements to provide for movement of the antenna 152 around a corresponding axis. As mentioned above, in other embodiments the mechanisms used to point the beam of the antenna 152 may be different.

Figure 5A:
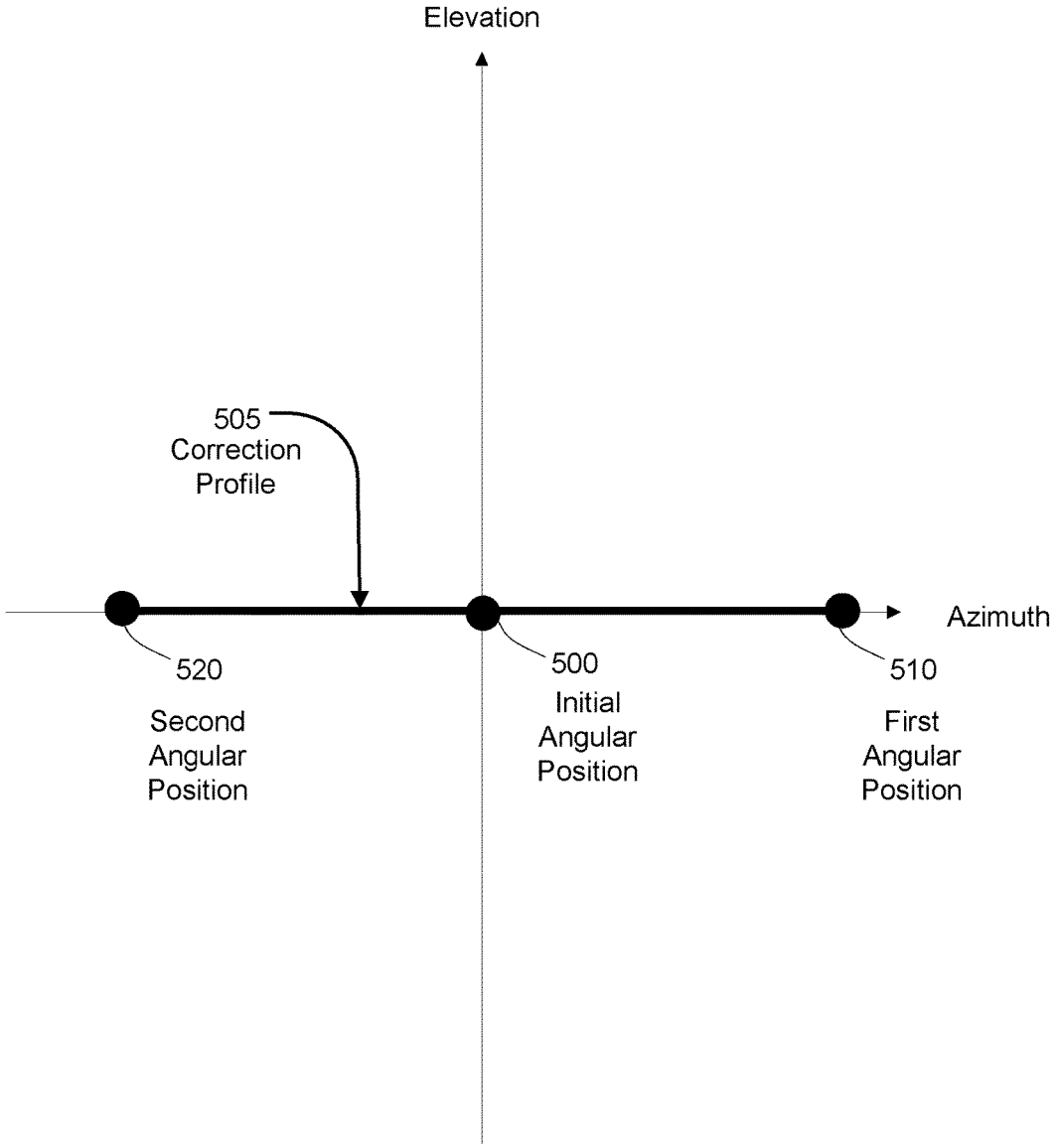
FIG. 5A illustrates an example of a correction profile versus azimuth and elevation angles of a mispointing correction operation as described herein.

FIG. 5A illustrates an example of a correction profile versus azimuth and elevation angles of a mispointing correction operation as described herein. In the illustrated embodiment, the correction profile 505 is a single axis operation in azimuth. Alternatively, the correction profile 505 may be different.

The plot of FIG. 5A is a projection of the angular positions onto a plane that is perpendicular to the initial angular position 500 extending out of the page. The correction profile 505 indicates the changes in azimuth and elevation angles relative to the initial angular position 500. At the beginning of the mispointing correction operation, the initial angular position 500 is the direction the positioner 320 is pointing the beam of the antenna 152 in the direction of the target satellite 110. As mentioned above, pointing error may have been introduced since the last mispointing correction operation was performed due to various factors. As a result, the initial angular position 500 may not correspond to the actual direction of the target satellite 110. In some embodiments, during the mispointing correction operation the antenna control unit 370 may continue to make adjustments to the initial angular position of the beam due to movement of the aircraft 102 relative to target satellite 110 in order to track the target satellite 110. In such a case, the actual value of the azimuth and elevation angles of the initial angular position 500 of the correction profile 505 may change during the mispointing correction operation. As a result, since the correction profile 505 is relative to the initial angular position 500, the actual values of the azimuth and elevation angles may also change.

In the illustrated embodiment, the antenna control unit 370 controls the positioner 320 to rapidly adjust the angular position of the beam of the antenna 152 between a first angular position 510 and a second angular position 520. As mentioned above, at the same time, the antenna control unit 370 obtains an indication of signal strength (or other signal metric) of a signal (e.g., forward downlink signal 114) communicated with the target satellite 110 at the various angular positions.

Figure 5B:
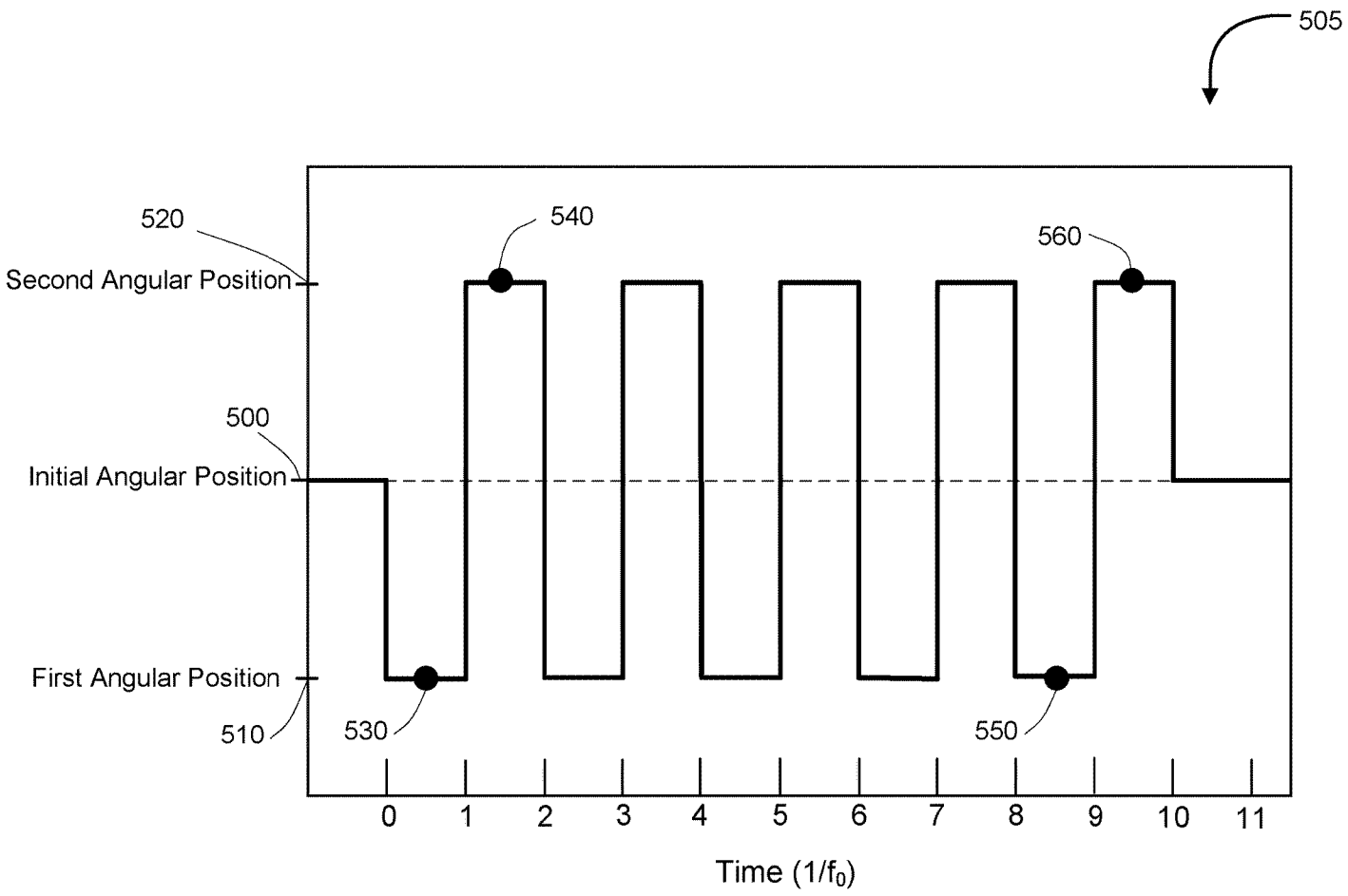
FIG. 5B illustrates an example of the correction profile of FIG. 5A versus time for a mispointing correction operation that can reduce or avoid pointing errors due to atmospheric scintillation effects.

FIG. 5B illustrates an example of the correction profile of FIG. 5A versus time for a mispointing correction operation that can reduce or avoid pointing errors due to atmospheric scintillation effects. The unit of time is based on the atmospheric scintillation spectrum of the signal being communicated and can vary from embodiment to embodiment. As described in more detail below, the time difference between each measurement at the first angular position 510 and at least one measurement at the second angular position is less than or equal to $1/f_0$ of the atmospheric scintillation spectrum of the measured signal communicated with the target satellite 110 during the mispointing correction operation. In the illustrated example, the correction profile 505 steps between the first angular position 510 and the second angular position 520. Thus, in the illustrated example, the time difference between neighboring measurements made at the first angular position 510 and the second angular position 520 is less than or equal to $1/f_0$. As mentioned above, the Fresnel frequency $f_0$ may be determined empirically and/or calculated and can vary from embodiment to embodiment based on the size of the aperture of the antenna 152 and the frequency of the signal being measured during the mispointing correction operation. In the illustrated embodiment, the time difference between neighboring measurements made at the first angular position 510 and the second angular position 520 is equal to $1/f_0$. Alternatively, the time difference may be less than $1/f_0$. Generally speaking, reducing the time difference further below $1/f_0$ results in a smaller the scintillation-induced signal variation between the first angular position 510 and the second angular position 520. This in turn can result in a smaller residual pointing error. In embodiments in which the pointing adjustment mechanism is a mechanical positioner, the minimum time difference may be limited by the rate at which the mechanical positioner can be moved. For example, the minimum time difference may be $\frac{1}{4}f_0$. As another example, the minimum time difference may be $\frac{1}{10}f_0$. In embodiments in which the pointing adjustment mechanism electronically scans the beam (e.g., the antenna 152 is a phased array), the minimum time difference may be smaller than a system having a mechanical positioner. For example, the minimum time difference may be $\frac{1}{100}f_0$, and may be limited by the rate at which measurements of the signal metric can be made by the transceiver 310 or other components of the antenna system 150.

In the example shown in FIG. 5B, the angular position of the beam of the antenna 152 is rapidly stepped back and forth between the first angular position 510 and the second angular position 520. The number of signal metric measurements that are made for each time period the beam of the antenna 152 is at one of the angular positions 510, 520 can vary from embodiment to embodiment. In some embodiments, a single signal metric measurement is made for each time period (e.g., in the middle of the time period of the step). In other embodiments, multiple signal metric measurements are made during a given time period.

The final measured signal metric at the first angular position 510 can be calculated by aggregating (e.g., averaging, weighted average, etc.) each of the signal metric measurements that were made when the beam of the antenna 152 was pointed at the first angular position 510. Similarly, the final measured signal metric at the second angular position 520 can be calculated by aggregating (e.g., averaging) each of the signal metric measurements that were made when the beam of the antenna 152 was pointed at the second angular position 520.

Because the time difference between neighboring measurements made at the first angular position 510 and the second angular position 520 is less than or equal to $1/f_0$, the scintillation-induced signal variations at those neighboring measurements are highly correlated. As a result, the difference between the neighboring measurements can be largely independent of the scintillation. For example, the scintillation-induced signal variation while at the first angular position 510 during time 530, is highly correlated with the scintillation-induced signal variation while at the second angular position 520 during time 540. Similarly, the scintillation-induced signal variation while at the first angular position 510 during time 550, is highly correlated with the scintillation-induced signal variation while at the second angular position 520 during time 560. It is worth nothing that, due to the relatively large amount of time between time 530 and time 560, the scintillation-induced signal variation at those times 530, 560 may be poorly correlated. However, because neighboring measurements are highly correlated, and the final signal metric of a given angular position is based on the measurements made when pointed at the given angular position, poor correlation among distant time measurements does not significantly affect the correlation of scintillation-induced variation between the final measured signal metrics at the first and second angular positions 510, 520 because the low-frequency signal variation due to the scintillation affects the final measurements at the first and second angular positions in a similar way.

Due to the spatial relationship of the first angular position 510 and the second angular position 520 on opposing sides of the initial angular position 500, the highly correlated scintillation-induced signal variations of neighboring measurements effect the estimate of actual direction of the target satellite 110 in similar, but opposite directions. That is, a scintillation-induced signal variation of a measurement at one angular position, which if random compared to a measurement at the opposing angular position could result in an erroneous shift in the estimate towards (or away from) that angular position, is instead counteracted because it is highly correlated with the scintillation-induced signal variation at the opposing angular position. The net result is that the final measured signal metrics at the first and second angular positions 510, 520 may be used to more accurately estimate the actual direction of the target satellite 110, as compared to uncorrelated signal variations.

Upon completing the correction profile 505, the antenna control unit 370 can then estimate the actual direction of the target satellite 110 based on the final signal metric measurements made at the first and second angular positions 510, 520. In some embodiments, the antenna control unit 370 may also obtain the signal metric when the beam of the antenna 152 was pointed at the initial angular position 500. A least-squares regression analysis or other technique may then be performed by the antenna control unit 370 to form a parabolic curve fitting the measured data. The antenna control unit 370 can then select the final angular position corresponding to the maximum signal maximum of the parabolic curve. In the illustrated embodiment, the correction profile 505 is a single axis operation in azimuth, and thus the selected final angular position is the final azimuth angle. The antenna control unit 370 may then perform another correction profile that is a single axis operation in elevation, and use similar techniques to determine the final elevation angle.

The antenna control unit 370 can then provide the control signal to the positioner 320 to adjust the beam of the antenna 152 to point in the selected angular position. The antenna control unit 370 can then return to normal operations, and provide further adjustments to the angular position of the beam as the aircraft 102 moves around relative to the target satellite 110.

In the illustrated example of FIG. 5B, the beam of the antenna 152 is moved to each of the first angular position 510 and the second angular position 520 at total number of five times. Alternatively, the total number of times at each of the first and second angular positions 510, 520 may be different than five. Most generally, the total number of times at each of the first and second angular positions 510, 520 may be one or more.

In embodiments in which the beam of the antenna 152 is moved only one time to each of the first angular position 510 and the second angular position 520, the total amount of time to perform the mispointing correction operation (and thus the amount of time the beam of the antenna 152 is intentionally mispointed) can be minimized. In embodiments in which the beam of the antenna 152 is moved multiple times to an angular position, the multiple measurements can be averaged (or otherwise aggregated) to determine the final signal metric measurement at that angular position. Doing so reduces noise generally as the square root of the number of measurements, which can further reduce errors in the final signal metric measurement at an angular position due to the scintillation and other types of noise sources, such as white noise sources having a time-invariant mean.

In the illustrated example of FIG. 5B, the correction profile 505 is a step function that steps between the first and second angular positions 510, 520. Alternatively, the correction profile 505 may be different than a step function, and final signal metric measurements may be made at one or more intermediate angular positions between the first and second angular positions 510, 520. For example, in some embodiments, the correction profile 505 moves between the first and first and second angular positions 510, 520 in a sinusoidal manner. As another example, in other embodiments, the correction profile moves between the first and second angular positions 510, 520 in a triangle or sawtooth manner. The final signal metric measurements at the first and second angular positions 510, 520 and the one or more intermediate angular positions can then be used by the antenna control unit 370 to estimate the actual direction of the target satellite 110 using for example the techniques described above.

In the illustrated example of FIGS. 5A-5B, each cycle of the correction profile 505 returns to first and second angular positions 510, 520. Alternatively, each cycle of the correction profile 505 may move between different pairs of angular positions.

Figure 6:
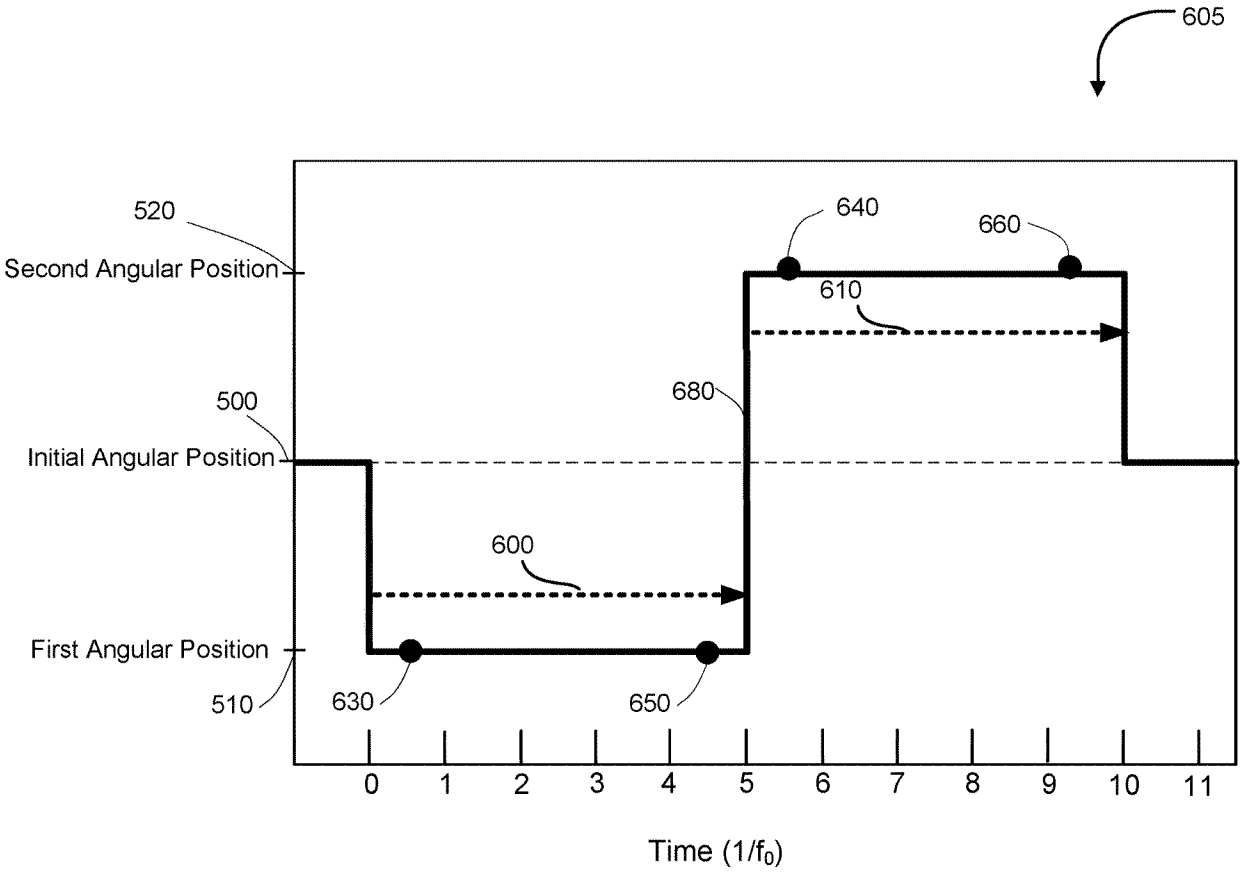
Fig. 6 (Prior Art)
FIG. 6 illustrates an example of the correction profile of FIG. 5A versus time for a conventional mispointing correction operation.

The increased accuracy of the estimate the actual direction of the target satellite 110 of the correction profile 505 of FIG. 5B can be further understood in comparison to the correction profile 605 of FIG. 6. In the correction profile 605 of FIG. 6, the total amount of time at each angular position 510, 520 is the same as the total amount of time as the correction profile 505 of FIG. 6. However, as explained below, the final measured signal metrics at the first and second angular positions 510, 520 of the correction profile 605 of FIG. 6 due to scintillation are poorly correlated, compared to that of the correction profile 505 of FIG. 5B. As a result, the correction profile 605 can lead to significantly larger pointing error if the correction profile 605 is used to estimate the actual direction of the target satellite 110, as compared to the correction profile 505 of FIG. 5B.

As shown in FIG. 6, the correction profile 605 first moves the beam of the antenna 152 to the first angular position 510 and remains there for a time period 600. During the time period 600, multiple measurements may be made that are then averaged together to calculate the final signal metric measurement at the first angular position 510. Next, the beam of the antenna 152 is moved to the second angular position 520 and remains there for a time period 610. Multiple measurements may be made during time period 610 and then averaged together to calculate the final signal metric measurement at the second angular position 520.

As a result of the relatively lengthy time periods 600, 610, the time difference between time 630 at the first angular position 510 and time 640 at the second angular position 520 can be much greater than $1/f_0$. In other words, the time difference between each measurement at the first angular position 510 is not within $1/f_0$ of at least one measurement at the second angular position 520. As a result, the scintillation-induced signal variation at those times 630, 640 may be poorly correlated. Similarly, the time difference between time 650 at the first angular position 510 and time 660 at the second angular position 520 can be much greater than $1/f_0$. It is worth noting that, due to the step 680 between the first angular position 510 and the second angular position 520, the scintillation-induced variation near the end of time period 600 (e.g. time 650) may be highly correlated the scintillation-induced variation near the beginning to time period 610 (e.g., 640). However, because of the relatively lengthy time periods 600, 610, the number of measurements during time period 600 and time period 610 having correlated scintillation-induced variation is small, relative to the overall number of measurements. In other words, in aggregate, the measurements in time periods 600, 610 are distant in time, resulting in scintillation-induced signal variation between the final measurements at the first and second angular positions 510, 520 that may be poorly correlated. This poor correlation randomly effects the final signal metric measurements at each of the first and second angular positions 510, 520, resulting in higher pointing error when estimating the actual direction of the target satellite 110.

The amount of improvement in the residual pointing error of a mispointing correction operation described herein, as compared to a conventional mispointing correction operation, can be characterized or represented in different ways and can vary from embodiment to embodiment. For example, in some embodiments the improvement is represented in terms of the relative reduction in the residual pointing error. The amount of relative reduction in the residual pointing error can vary from embodiment to embodiment based on a number of factors including the parameters of the mispointing correction operation described herein and the parameters of the conventional mispointing correction operation. In some embodiments, the residual pointing error using the mispointing correction operation described herein can be at least 5 times smaller than conventional mispointing correction operation.

Figure 7:
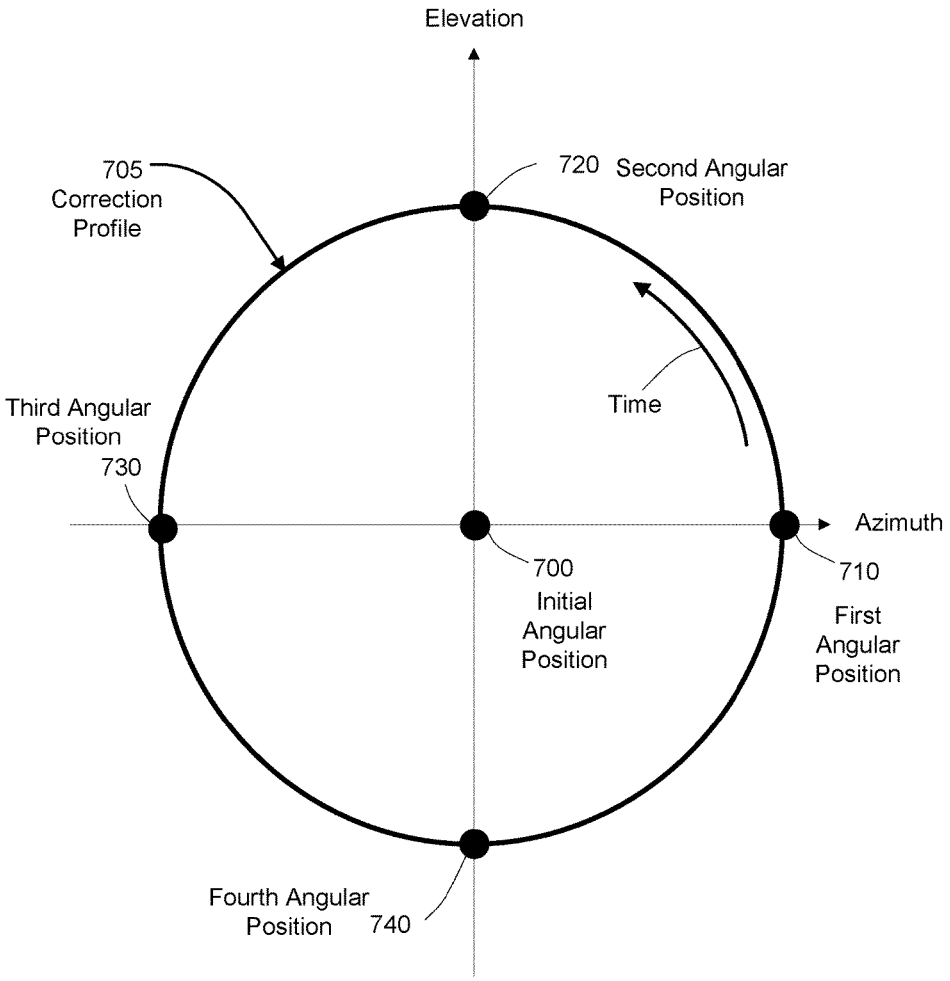
FIG. 7 illustrates a second example of a correction profile versus azimuth and elevation angles for a mispointing correction operation that can reduce or avoid pointing errors due to atmospheric scintillation effects.

FIG. 7 illustrates a second example of a correction profile 705 versus azimuth and elevation angles for a mispointing correction operation that can reduce or avoid pointing errors due to atmospheric scintillation effects. The plot of FIG. 7 is a projection of the angular positions onto a plane that is perpendicular to the initial angular position 700 extending out of the page. In the illustrated embodiment, the correction profile 705 is a two axis operation that simultaneously moves in both azimuth and elevation. As can be seen in FIG. 7, the correction profile 705 in FIG. 7 moves the angular position of the beam of the antenna 512 in a circular manner vs. time (counter-clockwise in this example). In other words, the correction profile 705 relative to the initial angular position 700 has a radius and an angular velocity. Alternatively, the correction profile 705 may be non-circular, such as being elliptical, a figure-eight, or any other shape.

The antenna control unit 370 controls the positioner 320 to rapidly adjust the angular position of the beam of the antenna 152 along the correction profile. As mentioned above, at the same time, the antenna control unit 370 obtains an indication of signal strength (or other signal metric) of a signal (e.g., forward downlink signal 114) communicated with the target satellite 110 at the various angular positions.

Similar to the discussion above with respect to FIGS. 5A-5B, the unit of time when moving around the correction profile 705 is based on the atmospheric scintillation spectrum of the signal being communicated and can vary from embodiment to embodiment. Specifically, the time difference between neighboring measurements made at a pair angular positions on opposing sides of the initial angular position 700 (e.g., first angular position 710 and third angular position 730) is less than or equal to $1/f_0$ of the atmospheric scintillation spectrum of the signal communicated with the target satellite 110 during the mispointing correction operation. As mentioned above, the Fresnel frequency $f_0$ may be determined empirically and/or calculated and can vary from embodiment to embodiment based on the size of the aperture of the antenna 152 and the frequency of the signal being communicated between the antenna system 150 and the target satellite 110. In the illustrated embodiment, the angular velocity is such that the time difference between neighboring measurements made at a pair of angular positions on opposing sides of the initial angular position 700 is equal to $1/f_0$. Alternatively, the time difference may be less than $1/f_0$.

In the illustrated embodiment, the angular positions at which measurements are made include a first pair of angular positions 710, 730 along the azimuth axis, and a second pair of angular positions 720, 740 along the elevation axis. In other embodiments, the number of pairs of angular positions may be different than two, and/or may be oriented relative to azimuth axis and elevation axis in a different manner.

The first pair of angular positions 710, 730 are spaced apart from the second pair of angular positions 720, 740 along the correction profile 705. In other words, each of the first pair angular positions 710, 730 have different angle values each of the second pair of angular positions 720, 740. In the illustrated example, the first pair of angular positions 710, 730 and the second pair of angular positions 720, 740 are spaced apart by 90 degrees in the plane. In other words, a first line defined by the first angular position 710 and the third angular position 730, and a second line defined by the second angular position 720 and the fourth angular position 740, are perpendicular to one another in the plane. Alternatively, the rotation of the first line relative to the second line may be other than 90 degrees.

Because the time difference between neighboring measurements made at the angular positions of an opposing pair is less than or equal to $1/f_0$, the scintillation-induced signal variations at those neighboring measurements are highly correlated. As a result, the difference between the neighboring measurements can be largely independent of the scintillation. For example, the scintillation-induced signal variation while at first angular position 710, is highly correlated with the scintillation-induced signal variation while at the third angular position 730. Similarly, the scintillation-induced signal variation while at second angular position 720 is highly correlated with the scintillation-induced signal variation while at the fourth angular position 740.

Due to the spatial relationship of the first angular position 710 and the third angular position 730 on opposing sides of the initial angular position 700, the highly correlated scintillation-induced signal variations of neighboring measurements effect the estimate of actual direction of the target satellite 110 in similar, but opposite directions. That is, a scintillation-induced signal variation of a measurement at one angular position, which if random compared to a measurement at the opposing angular position could result in an erroneous shift in the estimate towards (or away from) that angular position, is instead counteracted because it is highly correlated with the scintillation-induced signal variation at the opposing angular position. Similarly, the highly correlated scintillation-induced signal variations of neighboring measurements at the first and third angular positions 710, 730 effect the estimate of actual direction of the target satellite 110 in similar, but opposite directions. The net result is that the final measured signal metrics at the first and third angular positions 710, 730, and at the second and fourth angular positions 720, 740 may be used to more accurately estimate the actual direction of the target satellite 110, as compared to uncorrelated signal variations.

Upon completing the correction profile 705, the antenna control unit 370 can then estimate the actual direction of the target satellite 110 based on the final signal metric measurements made at the first, second, third and fourth angular positions 710, 720, 730, 740. In some embodiments, the antenna control unit 370 may also obtain the signal metric when the beam of the antenna 152 was pointed at the initial angular position 700. A least-squares regression analysis or other technique may then be performed by the antenna control unit 370 to form a 3-D curve fitting the measured data. The antenna control unit 370 can then select the final angular position corresponding to the maximum signal metric of the 3-D curve.

The antenna control unit 370 can then provide the control signal to the positioner 320 to adjust the beam of the antenna 152 to point in the selected angular position. The antenna control unit 370 can then return to normal operations, and provide further adjustments to the angular position of the beam as the aircraft 102 moves around relative to the target satellite 110.

The number of cycles the beam is moved around the correction profile 705 can vary from embodiment to embodiment. In embodiments in which the beam only one time around the correction profile 705, the total amount of time to perform the mispointing correction operation (and thus the amount of time the beam of the antenna 152 is intentionally mispointed) can be minimized. In embodiments in which the beam of the antenna 152 is moved multiple times around the correction profile 705, the multiple measurements at each angular position can be averaged to determine the final signal metric measurement at that angular position. Doing so can reduce errors in the final signal metric measurement at an angular position due to other types of noise sources, such as white noise sources having a time-invariant mean.

While the present disclosure is disclosed by reference to the preferred embodiments and examples detailed above, it is to be understood that these examples are intended in an illustrative rather than in a limiting sense. It is contemplated that modifications and combinations will readily occur to those skilled in the art, which modifications and combinations will be within the spirit of the invention and the scope of the following claims.

What is claimed is:

1. A method for reducing atmospheric scintillation-induced error in antenna pointing, the method comprising:

positioning, by a pointing adjustment mechanism, a beam of an antenna to an initial angular position towards a target satellite and communicating, from the antenna, a signal with the target satellite through the atmosphere;

performing, by an antenna control unit, a mispointing correction operation of the antenna, comprising:

adjusting the beam of the antenna to a plurality of angular positions along a correction profile and measuring a signal metric of the communicated signal at the plurality of angular positions, wherein the plurality of angular positions include a first angular position and a second angular position that are on opposing sides of the initial angular position, and wherein a time difference between each measurement of the signal metric at the first angular position of the correction profile and at least one measurement of the signal metric at the second angular position of the correction profile is less than or equal to $1/f_0$, where $f_0$ is a Fresnel frequency of an atmospheric scintillation spectrum of the communicated signal due to the atmosphere;

estimating an actual angular position of the target satellite based on the measured signal metric of the communicated signal at the plurality of angular positions; and positioning the beam of the antenna relative to the initial angular position based on the estimated angular position of the target satellite.

2. The method of claim 1, wherein:

the adjusting the beam of the antenna along the correction profile includes performing multiple adjustments of the beam of the antenna to each of the first and second angular positions and measuring the signal metric of the communicated signal; and the estimating the actual angular position of the target satellite is based on the multiple adjustments and measurements at the first and second angular positions.

3. The method of claim 1, wherein:

the plurality of angular positions further includes a third angular position and a fourth angular position that are on opposing sides of the initial angular position, the third and fourth angular positions spaced apart along the correction profile from the first and second angular positions; and a time difference between each measurement of the signal metric at the third angular position of the correction profile and at least one measurement of the signal metric at the fourth angular position of the correction profile is less than or equal to $1/f_0$.

4. The method of claim 3, wherein:

a projection of the first angular position and the second angular position onto a plane perpendicular to the initial angular position defines a first line; and a projection of the third angular position and the fourth angular position onto the plane defines a second line, the second line rotated relative to the first line.

5. The method of claim 4, wherein the second line is perpendicular to the first line.

6. The method of claim 1, wherein the correction profile is about a single axis of the antenna.

7. The method of claim 1, wherein the correction profile is about simultaneous multiple axes of the antenna.

8. The method of claim 1, wherein performing the mispointing correction operation reduces pointing error of the beam of the antenna towards the target satellite.

9. The method of claim 1, wherein the communicated signal is a signal received from the target satellite by the antenna.

10. The method of claim 1, wherein the signal metric is signal strength of the communicated signal.

11. An antenna system for reducing atmospheric scintillation error in antenna pointing, the antenna system comprising:

an antenna having a beam for communicating a signal with a target satellite through the atmosphere;

a pointing adjustment mechanism coupled to the antenna and responsive to a control signal to adjust an angular position of the beam of the antenna; and an antenna control unit to provide the control signal to the pointing adjustment mechanism to perform a mispointing correction operation of the antenna, the mispointing correction operation comprising:

adjusting the beam of the antenna to a plurality of angular positions along a correction profile and obtaining a signal metric of the communicated signal measured at the plurality of angular positions, wherein the plurality of angular positions include a first angular position and a second angular position that are on opposing sides of an initial angular position towards the target satellite, and wherein a time difference between each measurement of the signal metric at the first angular position of the correction profile and at least one measurement of the signal metric at the second angular position of the correction profile is less than or equal to $1/f_0$, where $f_0$ is a Fresnel frequency of an atmospheric scintillation spectrum of the communicated signal due to the atmosphere;

estimating an actual angular position of the target satellite based on the measured signal metric of the communicated signal at the plurality of angular positions; and positioning the beam of the antenna relative to the initial angular position based on the estimated angular position of the target satellite.

12. The antenna system of claim 11, wherein:

the adjusting the beam of the antenna along the correction profile includes performing multiple adjustments of the beam of the antenna to each of the first and second angular positions and obtaining the signal metric of the communicated signal; and the estimating the actual angular position of the target satellite is based on the multiple adjustments and measurements at the first and second angular positions.

13. The antenna system of claim 11, wherein:

the plurality of angular positions further includes a third angular position and a fourth angular position that are on opposing sides of the initial angular position, the third and fourth angular positions spaced apart along the correction profile from the first and second angular positions; and a time difference between each measurement of the signal metric at the third angular position of the correction profile and at least one measurement of the signal metric at the fourth angular position of the correction profile is less than or equal to $1/f_{o.}$

14. The antenna system of claim 13, wherein:

a projection of the first angular position and the second angular position onto a plane perpendicular to the initial angular position defines a first line; and a projection of the third angular position and the fourth angular position onto the plane defines a second line, the second line rotated relative to the first line.

15. The antenna system of claim 14, wherein the second line is perpendicular to the first line.

16. The antenna system of claim 11, wherein the correction profile is about a single axis of the antenna.

17. The antenna system of claim 11, wherein the correction profile is about simultaneous multiple axes of the antenna.

18. The antenna system of claim 11, wherein performing the mispointing correction operation reduces pointing error of the beam of the antenna towards the target satellite.

19. The antenna system of claim 11, wherein the communicated signal is a signal received from the target satellite.

20. The antenna system of claim 11, wherein the signal metric is signal strength of the communicated signal.

* * * * *